United States Patent [19]

Miller et al.

[11] 4,155,702

[45] May 22, 1979

[54] BURNER

[75] Inventors: Keith A. Miller; Terry R. Schartel, both of Allentown, Pa.

[73] Assignee: Air Products and Chemicals, Inc., Allentown, Pa.

[21] Appl. No.: 856,146

[22] Filed: Nov. 30, 1977

[51] Int. Cl.[2] ..... F23D 15/02

[52] U.S. Cl. ..... 431/353; 239/132.3; 239/422; 239/424.5

[58] Field of Search ..... 239/132.3, 422, 424.5; 431/353, 351

[56] References Cited

U.S. PATENT DOCUMENTS

| | | | |
|---|---|---|---|
| 3,224,679 | 12/1965 | Kear et al. | 239/132.3 |
| 3,344,834 | 10/1967 | Feinman et al. | 431/353 |
| 3,612,738 | 10/1971 | Jones et al. | 431/265 |
| 3,644,076 | 2/1972 | Bagge | 239/132.3 |
| 3,663,153 | 5/1972 | Bagge et al. | 431/351 |
| 3,856,457 | 12/1974 | Miller | 431/353 |
| 3,915,626 | 10/1975 | Miller | 431/354 |
| 4,017,253 | 4/1977 | Wielang et al. | 431/351 |

*Primary Examiner*—Carroll B. Dority, Jr.
*Attorney, Agent, or Firm*—E. Eugene Innis; James C. Simmons; Barry Moyerman

[57] ABSTRACT

A burner for combusting hydrocarbon fluids which may contain additional components as additives or contaminants and in the form of a gas, liquid or particulate matter, e.g. waste oil wherein the oil is atomized in a nozzle disposed in a housing defining a combustion chamber for receiving an oxidizing fluid, e.g. oxygen, so that atomized oil is mixed with the oxidizing fluid for combustion. Control of the length to diameter (L/D) ratio of the combustion chamber results in lower operating noise levels for the burner during combustion.

9 Claims, 1 Drawing Figure

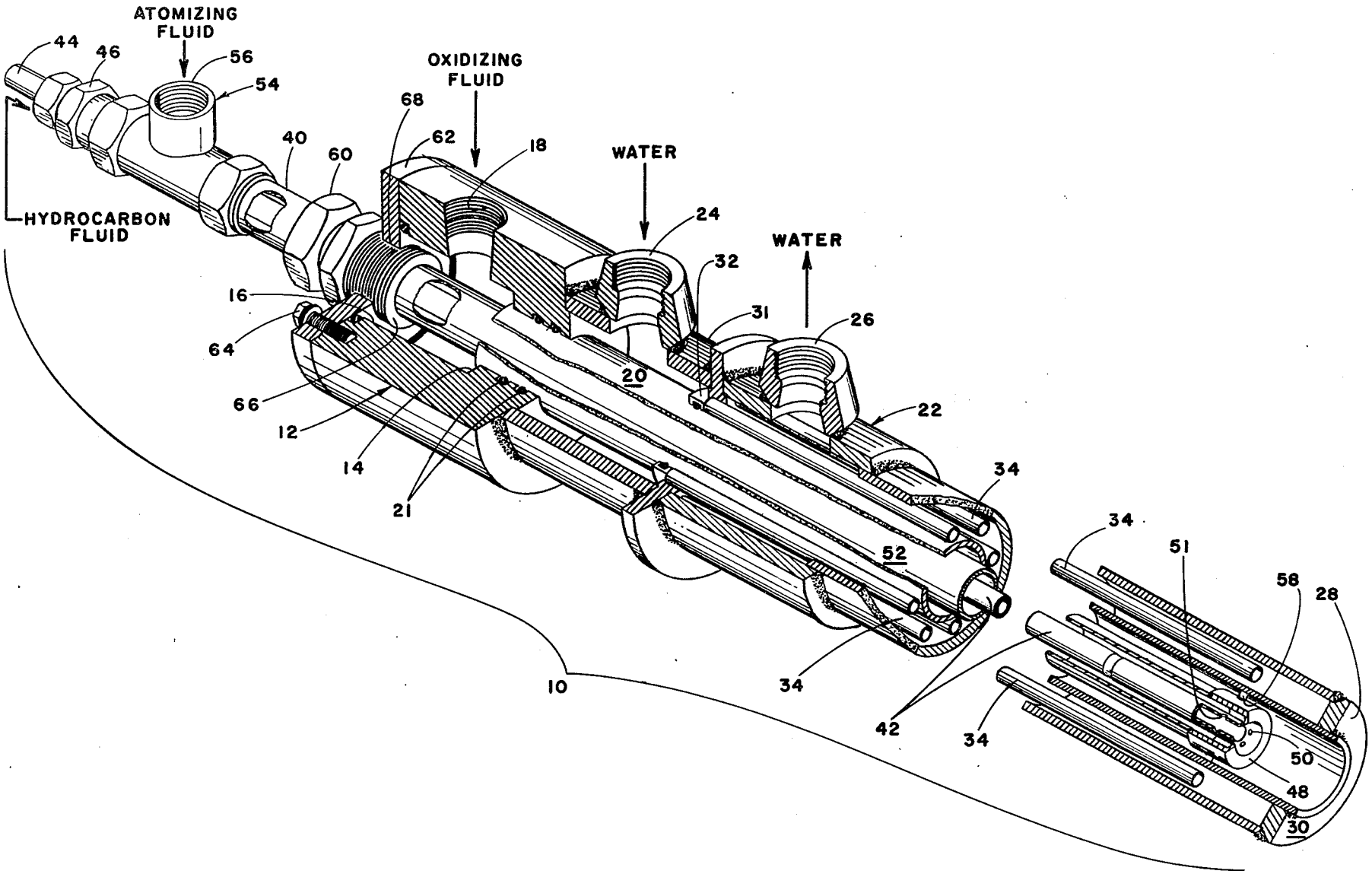
ATOMIZING FLUID
HYDROCARBON FLUID
OXIDIZING FLUID
WATER
WATER
44
46
56
54
40
60
68
62
18
24
32
31
26
22
20
16
64
66
12
14
21
10
52
42
34
34
34
51
58
28
50
48
30

BURNER

BACKGROUND OF THE INVENTION

1. Field of the Invention

This invention pertains to burners and in particular to an oxy-oil burner suitable for heating a furnace or other apparatus through the combustion of a hydrocarbon fluid containing particulate matter such as waste oil in the presence of an oxidizing fluid such as oxygen. Such burners are useful for recovering the heating value from waste oil material which may not otherwise be readily combusted while at the same time disposing of the material.

2. Description of the Prior Art

Oxy-oil burners of the single orifice type are shown in U.S. Pat. Nos. 3,224,679, 3,644,076 and 3,663,153. A multi-orifice burner used to burn fuel oil in the presence of oxygen is shown in U.S. Pat. No. 3,915,626 and a post-mix burner having a large combustion chamber is shown in U.S. Pat. No. 3,612,738.

All of the burners shown in the above-identified patents operate by combining an oxidizing fluid, e.g. oxygen, with a hydrocarbon liquid, e.g. fuel oil, to produce a flame. The flame is directed from the front of the burner toward an article or into a furnace to be heated. None of the prior art burners have been suitable for burning a waste-oil which normally contains particulate matter. In attempting to use prior art burners to combust this material, clogging and incomplete mixing of the fuel oil with the oxidizing fluid are characteristic.

SUMMARY OF THE INVENTION

The present invention relates to a burner suitable for combusting a hydrocarbon fluid-oxygen mixture wherein the hydrocarbon fluid contains additional components as additives or contaminants and in the form of a gas, liquid or particulate matter. The hydrocarbon fluid, e.g., waste oil, is atomized in a nozzle disposed in a housing defining a combustion chamber for receiving oxidizing fluid, e.g. oxygen, so that the atomized hydrocarbon fluid is mixed with the oxidizing fluid for complete combustion of the hydrocarbon fluid. Atomization of the hydrocarbon fluid is accomplished by using a separate atomizing fluid which can be steam or gaseous nitrogen thus effecting vaporization of the hydrocarbon fluid as it contacts the oxidizing fluid thus presenting a suitable mixture of atomizing fluid, hydrocarbon fluid, and oxidizing fluid for combustion. The construction of the burner results in a tip inside of a combustion chamber wherein the mixing takes place so that the base of the flame front is seated inside the combustion chamber to thus achieve stable combustion as well as reduced operating noise level of the burner.

Therefore, it is the primary object of this invention to provide an improved hydrocarbon fluid-oxygen burner.

It is a principal object of the present invention to provide an improved oxy-oil burner.

It is a further object of this invention to provide an oxy-oil burner suitable for combusting a hydrocarbon fluid containing additional components as additives or contaminants and in the form of a gas, liquid or particulate matter.

It is still another object of this invention to provide a burner of the oxy-oil type that is fluid cooled so that it can survive its operating environment when combusting a waste-oil product to provide heating for an enclosed vessel.

It is still a further object of this invention to provide an oxy-oil burner wherein an atomizing fluid is used to prepare the oil for mixing with the oxidizing fluid to effect efficient combustion of the oil.

BRIEF DESCRIPTION OF THE DRAWING

The single FIGURE is an isometric drawing of a burner according to the present invention with portions cut away to reveal the interior details thereof.

DETAILED DESCRIPTION OF THE PREFERRED EMBODIMENT

Referring to the single FIGURE of the drawing, there is shown a burner 10 having a head portion 12 in the shape of an open ended cylinder. For purposes of illustration, head 12 in the embodiment of the drawing includes a stepped inner cylindrical portion, a smaller diameter portion 14 on the housing end of the head 12 and a larger diameter portion 16 on the cover or service end of the head 12. The head 12 includes a suitable passage 18 containing threads so that a source of oxidizing fluid can be connected to port 18 through suitable couplings as are well-known in the art.

Disposed partially within and extending from the head 12 is a housing 20 in the form of an elongated cylindrical tube. A fluid tight seal between head 12 and housing 20 is achieved by means of suitable sealing devices such as "O-rings" 21.

Disposed around housing section 20 is a fluid, e.g. water, cooling jacket 22 containing a threaded inlet port 24 and a threaded outlet port 26 for receiving and discharging a fluid such as water for cooling the burner 10 while in service. The forward or nozzle end 28 of the burner is closed by a sealing ring 30. The water jacket utilized in the burner of this invention is identical to that disclosed in the embodiments depicted in FIGS. 4, 5 and 6 of U.S. Pat. No. 3,856,457, the specification of which is incorporated herein by reference. In a water jacket of the type shown as 22 in the drawing, water enters through fitting 24 into a chamber defined by the outer shell 31 of water jacket 22 and the outer surface of housing 20. The water is conducted through a plurality of tubes 34 to the nozzle end 28 of the burner where it circulates around the tubes and out through adaptor 26.

Disposed within housing 20 is an inner assembly shown generally as 40. Inner assembly 40 consists of a central conduit 42 having an entry end 44 fitted with a suitable seal 46 between conduit 42 and the housing 40. On the opposite end of conduit 42 a burner tip or nozzle 48 containing a plurality of radial apertures 50 and 51 is brazed or otherwise affixed to inner conduit 42. The burner tip is a model number LSA050-6R manufactured by Roy Industrial Products Company, Inc. of South Charleston, W.Va. and sold under the designation of a Ripco "R" series tip. Disposed about inner conduit 42 is a second or outer concentric conduit 52, one end of which is brazed or otherwise affixed to the tip 48 with the other end projecting out of the burner head 12 where it is joined to a suitable fitting such as a Tee union 54 containing an inlet port 56 with suitable threads or other fastening means so that a fluid conduit can be connected thereto. A plurality of cylindrical spacers 58 are affixed to the tip 48 so that the tip 48 can be disposed concentrically within housing 20. The tip arrangement is such that the longitudinal axial center lines of conduit 42, conduit 52 and tip 48 lie along the longitudinal axial center line of housing 20. Assembly 40 includes a suitable fluid tight compression fitting 60 so that the position of the tip 48 can be moved relative to nozzle end 30 of the burner 10. Compression fitting 60 is secured to a cover plate 62 affixed to head 12 of burner 10 as by a plurality of cap screws 64, only one of which is shown for clarity of illustration. Mating of the fitting 60 and head 62 is accomplished via complimentary male threads on depending portion 66 of fitting 60 and female threads in aperture 68 of cover 62.

The position of the tip 48 relative to the end 28 of burner 10 defines a combustion chamber having a diameter which is defined by the inside diameter of housing 20. The length of the combustion chamber is determined by the distance from the end 28 of housing 20 to the burner tip 48 as measured along the longitudinal axis of housing 20.

In operating the burner 10, the procedure includes installing the burner 10 on a test stand or in a vessel to be heated by techniques well-known in the art. Adaptors 24 and 26 are connected to a source of water and a discharge receptacle, respectively, so that the burner can be cooled while in service. Adaptor 18 is connected to a source of oxidizing fluid such as a gaseous oxygen. Adaptor 56 is connected to a source of atomization fluid such as gaseous nitrogen or steam and conduit 42 is connected through adaptor 46 to a source of hydrocarbon fluid such as waste oil containing particulate matter having a maximum size of 0.25 inches in diameter. In operation, a suitable pilot light (not shown) may be provided as required at the nozzle end 28 of burner 10. In those applications where the burner is placed in a vessel at an elevated temperature, the temperature if high enough, can cause ignition of the mixture thus eliminating the need for a separate pilot light. Cooling water flow is started and the flow rate adjusted. Next, atomization fluid flow is initiated and the flow rate adjusted according to a preselected rate which is determined by the intended firing rate of the burner as is well-known in the art. Based upon the firing rate, a preset flow rate of oxygen is then supplied to the burner and hydrocarbon fluid, e.g. oil, supply initiated and gradually increased until the desired flow rate is achieved. At this point, the burner firing rate is established and the burner is operated in a steady state condition.

In order to change the firing rate, the operator would first change the flow rate of the atomization fluid to the new rate. After the atomization fluid flow is increased, the oil and oxygen flow rates would be increased simultaneously to new flow rates, the rate of oxygen increase generally trailing that of the oil.

After the burner is in operation and is to be shut down, the procedure involves halting oil flow, allowing the atomization fluid to continue until all of the oil is effectively purged from the burner, terminating oxygen flow, and lastly, terminating flow of atomizing fluid.

A burner according to the invention was fired at several length to diameter ratios (L/D) to determine at which L/D ratio the burner operated with the lowest noise level. Reducing the operating noise level of a burner by paying attention to the L/D ratio is disclosed in U.S. Pat. Nos. 3,915,626 and 3,856,457.

With the burner of the present invention, it was found that maximum sound level tends to increase with increasing L/D ratio for all firing rates. An L/D ratio of from 0 to 4 was found to be satisfactory to achieve combustion and stable operation of the burner.

Set out below in Table 1 is a summary of results using a 4½" outside diameter oxy-oil burner according to the present invention wherein nitrogen is used as an atomization fluid.

TABLE I

Summary of Results of 4.5" O.D. Oxy-Oil Burner Tests Using Nitrogen as the Atomization Fluid

| L/D Ratio | Firing Rate Range MM BTU/HR | Maximum Sound Level at Maximum Firing Rate dB/A | Maximum Sound Level at Maximum Firing Rate dB at Frequency |
|---|---|---|---|
| 1.54 | 1.83- 6.47 | 109 | 106 at 1,000 |
| 2.0 | 1.83- 9.70 | 115 | 110 at 2,000 |
| 3.0 | 1.83-10.8 | 115 | 110 at 1,000 |

From the foregoing it is apparent that at an L/D ratio of 1.54, the operating noise level of the burner is at its lowest point.

Further sound recordings were taken using a technique where the sound measurements were taken at various angles to the longitudinal axis of the burner. The angle from the burner axis A is given by the formula $A=(n-6)\times 15$ where A is in degrees, measured positive in a clockwise direction from the burner axis oriented with the flame jet at A=0. The small letter n in the above equation is the integer value of the sensor position, ranging from 0 to 6. Data was taken utilizing a General Radio Permissible Sound Level Meter Type 1565-B calibrated with a General Radio Permissible Sound Level Calibrator Type 1562-A.

TABLE II

Test Data For Radial Sound Level Measurement Using Nitrogen As The Atomization Fluid

| Firing Rate MM BTU/HR* | Sensor Position | Sound Level $dB_A$ | Oil Pressure PSIG | Nitrogen Pressure PSIG | Oil Flow Rate GPH | Oxygen Flow Rate SCFH | Nitrogen Flow Rate SCFH |
|---|---|---|---|---|---|---|---|
| L/D = 1.54 | | | | | | | |
| 8.40 | 0 | 109 | 21.5 | 34.7 | 60 | 17,000 | 27.8 |
| | 1 | 107 | | | | | |
| | 2 | 107 | | | | | |
| | 3 | 103 | | | | | |
| | 4 | 101 | | | | | |
| | 5 | 101 | | | | | |
| | 6 | 101 | | | | | |
| L/D = 2 | | | | | | | |
| 12.60 | 0 | 115 | 39.5 | 31.5 | 90 | 25,400 | 36.9 |
| | 1 | 114 | | | | | |
| | 2 | 116 | | | | | |
| | 3 | 112 | | | | | |
| | 4 | 109 | | | | | |
| | 5 | 104 | | | | | |
| | 6 | 103 | | | | | |
| L/D = 3 | | | | | | | |
| 14.0 | 0 | 115 | 38.0 | 26.7 | 100 | 28,200 | 27.7 |
| | 1 | 115 | | | | | |
| | 2 | 116 | | | | | |

TABLE II-continued

Test Data For Radial Sound Level Measurement Using Nitrogen As The Atomization Fluid

| Firing Rate MM BTU/HR* | Sensor Position | Sound Level $dB_A$ | Oil Pressure PSIG | Nitrogen Pressure PSIG | Oil Flow Rate GPH | Oxygen Flow Rate SCFH | Nitrogen Flow Rate SCFH |
|---|---|---|---|---|---|---|---|
| | 3 | 114.5 | | | | | |
| | 4 | 112 | | | | | |
| | 5 | 110 | | | | | |
| | 6 | 104 | | | | | |

*Based upon 140,000 BTU/gal. oil

From the foregoing it is apparent that at the L/D ratio of 1.54, when nitrogen is the atomizing fluid, the burner operates with a lower overall noise level.

Similar tests using steam as the atomization fluid confirm the fact that at an L/D ratio of 1.54, the burner had the lowest overall operating noise level.

In comparison to oxy-gas burners which have an optimum L/D ratio of 4, the L/D ratio of 1.54 for a burner according to the present invention is somewhat surprising.

It is theorized that the larger and longer confined mixing volume may be the reason for sound levels which peak at lower frequencies with a burner according to the present invention. Also, the funneling of the combusting gases through the longer mixing volume may also direct the sound waves so that their diffusion is less rapid than observed with other burners. Limited or reduced dispersion rate of the sound waves may account for maximum sound levels occuring at an angle of approximately 60° from the burner axis.

Apart from the reduced operating noise level, the key feature of the burner according to the present invention is its ability to combust a hydrocarbon fluid containing particulate matter. There is a growing need for utilization of waste oil contaminated with particulate matter which waste oil has heretofore not been utilized for its inherent heating value.

One such product was a sludge mixture containing approximately 50% $H_2SO_4$ and 50% oil which is a waste product from a refinery. This waste product contained particulate solids having a maximum diameter of 0.25 inches.

A burner utilizing a LSA050-6R tip will be able to combust fluids containing particulate matter having a diameter up to 0.25". For fluid with larger particulate material, a larger tip must be used and, in some cases, a larger diameter burner will be required.

While the burner of our invention has been described in relation to oil or waste oil as the fluid being combusted, the burner can be used to combust a myriad of hydrocarbon fluids such as natural gas, benzene, syn-gas and the like with or without entrained materials such as particulate matter, e.g. coal.

Having thus described our invention what we desire to be secured by Letters Patent of the United States is set forth in the appended claims.

What is claimed is:

1. A burner adapted to combust a hydrocarbon fluid containing additional components as additives or contaminants in the form of a gas, liquid or particulate matter comprising in combination an open-ended generally cylindrical shaped head having means for admitting a fluid to the interior of said head;

a housing section extending from a first end of said head and defining an elongated housing terminating in a burner nozzle opening;

a fluid cooling jacket including inlet and outlet means attached to said head and said housing for continuously cooling a major portion of said burner when in service;

an inner assembly disposed within said housing section and extending exteriorly of said burner through a second end of said head said inner assembly including an atomizing tip containing a plurality of apertures directed radially inward and located inside said housing, said tip affixed to a pair of concentric pipes defining a first or inner passage adapted to conduct a hydrocarbon fluid to said tip and a second or surrounding passage to conduct an atomizing fluid to said tip through said apertures and into contact with said hydrocarbon fluid, said concentric pipes projecting beyond said burner head and adapted to be connected to a source of hydrocarbon fluid and an atomizing fluid; said housing being spaced from an outer of said concentric pipes to form an oxidizing passage therebetween; means in said head for supplying oxidizing fluid to said oxidizing fluid passage; said tip being longitudinally spaced from the nozzle opening to define a cylindrical combustion chamber, there being an annular spacing between said tips and said housing for discharging oxidizing fluid from said oxidizing passage to said combustion chamber; and a cover closing said second end of said head and supporting said assembly projecting therethrough;

whereby when said burner is in service, a contaminated hydrocarbon fluid is atomized at the tip and further mixed with an oxidizing fluid wherein in the presence of an ignition source combustion can be initiated.

2. An apparatus according to claim 1 wherein said inner assembly includes means for positioning the tip at various positions from the nozzle end of said burner.

3. An apparatus according to claim 1 wherein said housing and said tip are cylindrical and disposed along a common longitudinal axis.

4. A burner according to claim 1 wherein the spacing between the nozzle end of said housing and said tip defines a combustion chamber having a length-to-length diameter (L/D) ratio of between 0 and 4.

5. A burner according to claim 4 wherein the L/D ratio is 1.54.

6. A burner according to claim 1 wherein the oxidizing fluid is oxygen.

7. A burner according to claim 1 wherein the atomizing fluid is steam.

8. A burner according to claim 1 wherein the atomizing fluid is nitrogen.

9. A burner according to claim 1 wherein said cover is adapted to support the projecting end of said assembly in fluid tight relationship and includes means to allow for moveably repositioning said assembly to position said tip in relation to said nozzle end of said housing.

* * * * *